US005177813A

United States Patent [19]

Bosack et al.

[11] Patent Number: 5,177,813

[45] Date of Patent: Jan. 12, 1993

[54] SHIRTTAIL RETAINING HARNESS

[75] Inventors: Robert C. Bosack, 8718 Flint La., Orland Park, Ill. 60462; Michael D. Lake, Chicago, Ill.

[73] Assignee: Robert C. Bosack, Orland Park, Ill.

[21] Appl. No.: 803,175

[22] Filed: Dec. 5, 1991

[51] Int. Cl.[5] ..... A41F 17/00

[52] U.S. Cl. ..... 2/323; 2/325; 2/333; 2/336; 2/340; 24/564

[58] Field of Search ..... 2/107, 112, 117, 223, 2/229, 300, 303, 306, 323, 325, 326, 330, 332, 333, 334, 335, 336, 340; 24/507, 541, 562, 564

[56] References Cited

U.S. PATENT DOCUMENTS

| | | | |
|---|---|---|---|
| 152,592 | 6/1874 | Borone | 2/333 |
| 166,974 | 8/1875 | Eddy | 2/333 |
| 397,061 | 1/1889 | Atwood | 2/334 |
| 863,970 | 8/1907 | Ebersole | 2/326 |
| 963,083 | 7/1910 | Small | 2/333 |
| 1,382,446 | 6/1921 | Warren | 2/326 |
| 1,398,288 | 11/1921 | Watkins | 24/507 X |
| 1,404,719 | 1/1922 | Postl | 2/335 |
| 1,653,288 | 12/1927 | Johnson | 2/326 |
| 1,844,774 | 2/1932 | Locki | 24/507 |
| 2,089,474 | 8/1937 | Glick | 2/333 |
| 2,401,413 | 6/1946 | Cdwell | 24/507 X |
| 2,508,049 | 5/1950 | Tuck | 2/229 |
| 2,551,165 | 5/1951 | Rochat | 2/333 |
| 2,727,247 | 12/1955 | Bailey | 2/323 |
| 2,766,500 | 10/1956 | Chanko | 24/507 X |
| 3,052,891 | 9/1962 | Panepinto | 2/326 X |
| 3,214,810 | 11/1965 | Mathison | 24/562 X |
| 3,780,402 | 12/1973 | Takobyashi | 24/507 X |
| 3,914,828 | 10/1975 | Noda | 24/507 |
| 4,005,510 | 2/1977 | Noda | 24/507 X |
| 4,074,364 | 2/1978 | Lucero | 2/117 |
| 4,084,299 | 4/1978 | Noda | 24/507 X |
| 4,853,979 | 8/1989 | Ryder | 2/326 |
| 4,937,886 | 7/1990 | Ellis | 2/323 |

FOREIGN PATENT DOCUMENTS

| | | | |
|---|---|---|---|
| 598515 | 10/1959 | Italy | 2/323 |
| 630353 | 12/1961 | Italy | 2/326 |
| 330795 | 6/1930 | United Kingdom | 2/325 |

*Primary Examiner*—Werner H. Schroeder
*Assistant Examiner*—Jeanette E. Chapman
*Attorney, Agent, or Firm*—Wallenstein Wagner & Hattis, Ltd.

[57] ABSTRACT

A shirttail retaining harness (10) is disclosed comprising a pair of elongate straps (12, 14), a means for connecting the straps to a garment (18) and, a connecting member (16) which retains a portion of the straps in spaced relation. The connecting member (16) is located away from the crotch and genital area of a wearer. The shirttail retaining harness (10) is adapted so that, in use, the straps (12, 14) thereof pass along the inside of the thighs of the wearer in the crotch area and diverge at both ends for attachment to a shirttail. An optional clasp (19) is also provided wherein the shirttail cloth is gripped between a protruding member (**18*e*) and a layer of resilient material (18*f***).

11 Claims, 4 Drawing Sheets

SHIRTTAIL RETAINING HARNESS

Technical Field

The present invention relates generally to undergarments and specifically to a device which may be used to retain shirttails in a neat, tucked-in position.

BACKGROUND OF THE INVENTION

For neat appearance and for safety around equipment which can catch loose garments, the tails of upper garments, such as shirts and blouses, are conventionally tucked into the lower garment of a wearer. However, moderate activity such as raising of the wearers arms or sitting and standing frequently pulls the shirttails from a fully tucked-in position and sometimes the shirttails become completely untucked. Thus, there is a need for a device which will retain the tails of a shirt, blouse or other upper garment in a tucked-in position.

Others have attempted to provide such a device. For example, U.S. Pat. No. 4,074,364 to Lucero discloses a hold-down device for shirts, blouses, etc. comprising an elastic hip band to be worn around the hips. An elastic front and rear flap is secured to the hip band and both converge downwardly to fit the crotch of the wearer. An upper garment is attached to the hold-down device by a plurality of upstanding tabs spaced around the hip band. Although the Lucero patent recognizes the problems associated with maintaining a tucked-in position of shirttails and blouses, it has deficiencies.

For example, the Lucero device utilizes a relatively large quantity of material to comprise its support structure which increases its cost. Similarly the structure requires a relatively complex connecting structure for the end user to put on and secure to a shirttail. The waist band adds undesirably to the girth of the wearer. Also, the structure of the device, specifically the front flap, covers the genitals. This becomes a problem when the normal forces, which tend to untuck the shirttail, pull up on the flap and impinge uncomfortably on the genitals.

U.S. Pat. No. 4,596,569 to Campbell discloses a shirt hold-down device for diaper-wearing infants and toddlers. This device has an elongated elastic unit fitting between the legs, over a diaper and has garter-type fasteners on each end for gripping the shirt of the infant. The garment comprises an inside and outside fabric panel, with four anchor loops and four detachable garter-type fasteners. The Campbell device suffers some of the same deficiencies as the Lucero device. For example, the panels cover the genital area. Although, this may not be a problem when used with the padded diaper of an infant it could be a problem for use on older children or adults.

U.S. Pat. No. 4,937,886 to Ellis discloses another accessory for children's or infants' clothing comprising a hold-down device of elasticized fabric having a relatively wide elongated central panel portion from which straps extend. This panel portion could also impinge uncomfortably upon the genitals.

It is an object of the present invention to overcome these deficiencies and to provide a shirttail retaining harness which: is comfortable; utilizes a minimum of materials and manufacturing effort; and, requires minimum effort for usage by a wearer. Specifically it is an object to provide a shirt-tail retaining harness which is adjustable, is lightweight, and does not impinge on the genital area of the wearer.

It is also an object of the invention to provide a means of attaching the harness securely to a shirttail without damaging the material thereof.

SUMMARY OF THE INVENTION

A shirttail retaining harness is disclosed comprising a pair of elongate straps, a means for connecting the straps to a garment and, a connecting member which retains a portion of the straps in spaced relation. The connecting member is located away from the crotch and genital area of a wearer. The shirttail retaining harness is adapted so that, in use, the straps thereof pass along the inside of the thighs of the wearer in the crotch area and diverge at both ends for attachment to a shirttail.

Another aspect of the invention provides a means for adjusting the connecting member along a length of the straps for maximizing efficacy and comfort.

Another aspect of the invention provides means for adjusting a length of the straps to fit the harness to a particular wearer and to a particular length of shirttail involved. Another aspect of the invention provides that the straps are elastic to permit a range of movement by the wearer.

Another aspect of the invention provides that the means for attaching the straps to a garment includes each end of each strap having a cloth gripping member attached thereto. Each cloth gripping member comprising a pair of jaws cooperatively joined to provide an open and a closed position. Teeth on each jaw, are cooperably aligned to mesh or interdigitate in the closed position of the jaws. Means to lock the jaws into a closed position are provided.

Another aspect of the invention provides that the teeth are arranged in a plurality of rows along a length of the jaws. Another aspect provides that the teeth are arranged in a plurality of rows along the width of the jaws, while still another provides that the teeth are arranged in a generally circular row on the jaws.

Another aspect of the invention provides that one jaw has generally protruding teeth which engage into contact with a resilient material, such as rubber, when closed. In this embodiment, the cloth of the shirt tail is frictionally engaged by the rubber which resiliently squeezes the cloth against the teeth of the mating jaw without damaging the cloth.

Another aspect of the invention provides that the connecting member comprises a generally flat, thin member for comfort. A first and second set of slots is provided on the flat, thin member. One strap is weaved through the first set of slots and the other strap is weaved through the second set of slots. The slots are suitably spaced to provide that the straps do not bunch the shirttail at the rear of the wearer.

Another aspect of the invention provides that the flat, thin member is flexible.

Another aspect of the invention provides that the first and second set of slots are aligned with respect to each other to cause the pair of straps weaved therethrough to converge at one portion for passage through the crotch area and diverge at another portion for spaced attachment to a shirttail.

Another aspect of the invention provides that the means for connecting the straps to a garment includes a loop on each end of each strap and a separate flexible tether extending through each loop. The tethers have opposed ends, and each of the opposed ends has a means for gripping a garment.

Other advantages and aspects of the invention will become apparent upon making reference to the specification, claims, and drawings to follow.

DETAILED DESCRIPTION OF THE INVENTION

Figure 1:
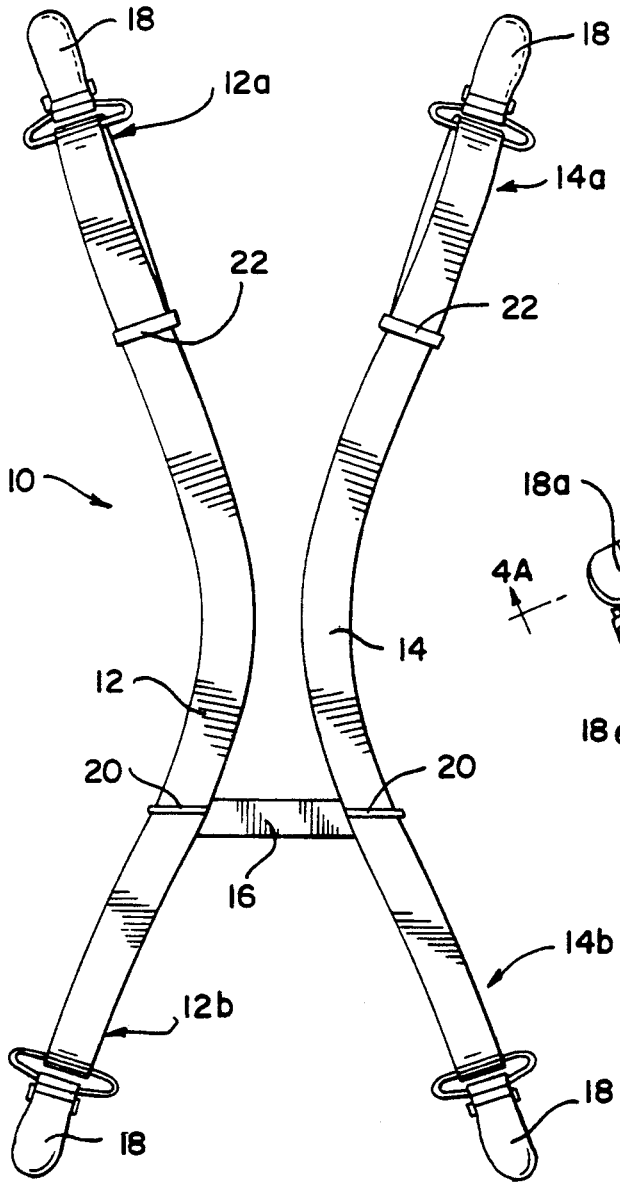
FIG. 1 is a top plan view of the shirttail retaining harness.

While this invention is susceptible of embodiment in many different forms, there is shown in the drawings and will herein be described in detail preferred embodiments of the invention. The present disclosure is to be considered as an exemplification of the principles of the invention and is not intended to limit the broad aspect of the invention to embodiments illustrated.

FIG. 1 discloses a shirttail retaining harness 10 (or harness 10) according to the present invention. The harness 10 has a pair of elongate straps 12 and 14 and a connecting member 16 for connecting the straps 12 and 14 in spaced relation (as best disclosed in FIG. 3). Each strap has opposed anterior and posterior ends **12*a*, 12*b* and 14*a*, 14*b* respectively which are each provided with clasps 18 for attaching the straps 12 and 14** to the fabric of an upper garment, such as a shirttail, or any marginal edge of an upper garment.

Figure 3:
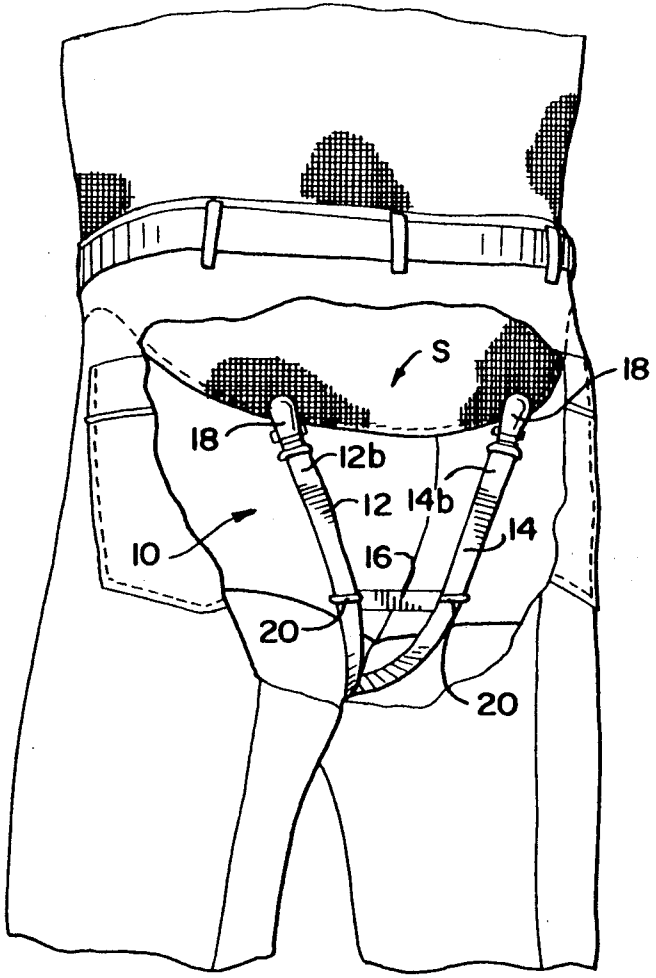
FIG. 3 is a perspective view showing a preferred embodiment of the invention in an exemplary configuration on the rear of a wearer with a cutaway of the outer garment.
Figure 2:
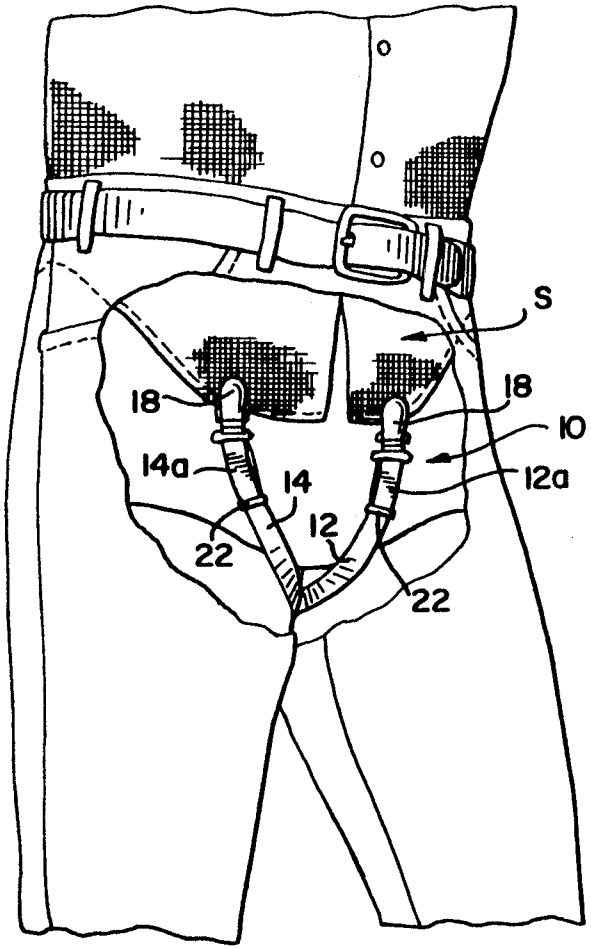
FIG. 2 is a perspective view showing a preferred embodiment of the invention in an exemplary configuration on the front of a wearer with a cutaway of the outer garment.

FIGS. 2 and 3 disclose the harness 10 in use on a wearer with a tucked-in shirttail referenced by S in the Figures. In use, the straps 12 and 14 pass along lateral sides of the crotch of the wearer. The straps 12 and 14 are attached along front and rear portions of the marginal edge of the shirttail S. Preferably, the straps 12 and 14 are elastic to provide a constant force to maintain a tucked-in shirt position. In other embodiments it is contemplated that only a portion of the straps 12 and 14 are elastic depending on the desired cost of materials and desired amount of elastic tension to be provided to the straps. The elasticity of the straps also provides that normal movement by the wearer will not put uncomfortable stress on the wearer.

The connecting member 16 is sufficiently rigid to maintain the straps in spaced relation as disclosed in FIG. 3. In a preferred embodiment the connecting member is a pliable plastic.

According to the invention, the connecting member 16 is situated closer to one end of the pair of straps 12 and 14 than the other so as be free of the crotch and genital areas. This provides that harness 10 will not impinge on the genitals when the shirttail S is pulled upwardly by the wearers movement or body position. Preferably, as shown in FIG. 3, the connecting member 16 is placed at the posterior side of the wearer to avoid the straps 12 and 14 coming together and bunching at the posterior of the wearer as the straps 12 and 14 diverge from the crotch and buttocks of the wearer. This also prevents medial pull of the posterior shirttail S.

According to another aspect of the invention, the connecting member 16 is adjustable along a length of the straps 12 and 14. As best disclosed in FIG. 1, the connecting member has a slot 20 on each opposite end thereof. The straps 12 and 14 are weaved through the slots 20. The slots 20 are dimensioned to present a frictional or interference fit with the straps 12 and 14 so that the connecting member may be slid by hand along the straps 12 and 14 but the connecting member 16 will not slide during normal wearer activity.

The straps 12 and 14 and the connecting member 16 are generally flat for comfort and are meant to be washable and adjustable.

According to another aspect of the invention, the straps 12 and 14 provide means for individual length adjustment. Thus a wearer can adjust the length of the straps to accommodate varying lengths of shirttails and the desired elastic pull and comfort level. As best disclosed in FIG. 1, length adjustment is provided by conventional strap adjustment loops 22. Preferably, the loops 22 are situated on the anterior ends **12*a* and 14*a* so as to be in front of the wearer to provide for ease of adjustment while the harness 10** is attached to the shirttails S.

It should be noted that for maximum efficacy of the harness 10, the paired opposed ends **12*a*, 14*a* and 12*b*, 14*b* should be attached in spaced relation on the garment as shown in FIGS. 2 and 3. Also, as disclosed in FIGS. 2 and 3, on a shirt or blouse which is openable and closable by buttons or the like, the anterior ends 12*a* and 14*a* of the straps 12 and 14** should be placed on opposite sides of the button line.

It is also noted that the harness may be made from materials which enhance its aesthetic characteristics, such as colored material or fanciful designs on the material.

Figure 4:
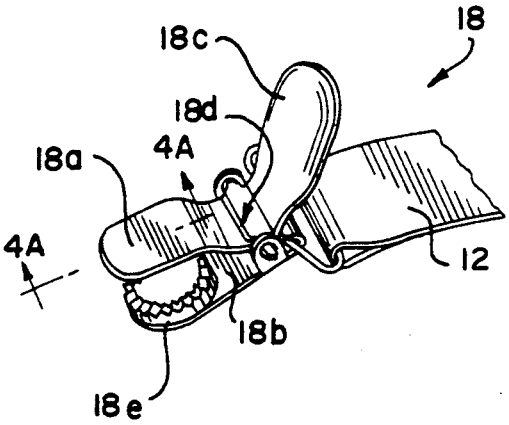
FIG. 4 is a partial view in perspective of the shirttail retaining harness showing one preferred garment clasp thereof for attaching the harness to a garment.
Figure 4A:
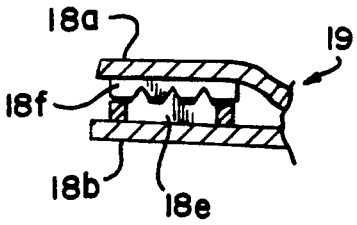
FIG. 4A is a cross sectional view of the preferred garment clasp of FIG. 4 taken along line A—A of FIG. 4 and disclosing a novel modification thereof for attaching the harness to a garment.
Figure 5:
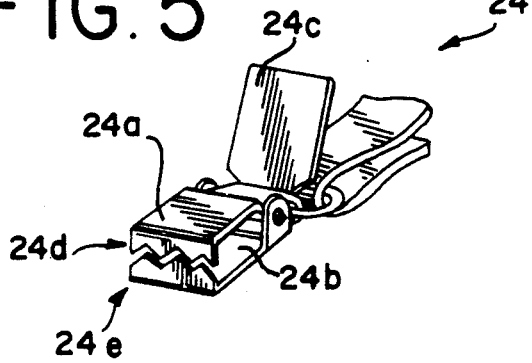
FIG. 5 is a partial view in perspective of the shirttail retaining harness showing another preferred garment clasp thereof for attaching the harness to a garment.

It will be appreciated that according to a broad aspect of the invention, any suitable conventional material gripping clasp could be used, such as clasp 18 disclosed in FIG. 4, clasp 19 disclosed in FIG. 4A or clasp 24 disclosed in FIG. 5.

FIG. 4 discloses a conventional clasp 18 which includes an upper jaw **18*a*, a lower jaw 18*b* and a closer lever 18*c* which provides a fulcrum 18*d* to close and lock the jaws 18*a* and 18*b* together as is known in the art. A circular row of teeth 18*e* are provided on the lower jaw 18*b* to grip material between the teeth 18*e*** and the upper jaw 18*a* when the jaws are in a closed position.

FIG. 4A provides a novel clasp 19 which is the same as clasp 18 except that a flat layer of resilient material 18*f* is attached to the upper jaw 18*a*. The protruding teeth 18*e* resiliently engage into the resilient layer 18*f* when the jaws 18*a* and 18*b* are in the closed position, as shown in FIG. 4A. The resilient material can be any form of elastomeric material such as rubber. The cloth of a shirttail C (not shown) is gripped between the teeth 18*e* and the resilient layer when the jaws are in a closed position. The resilient layer 18*f* resiliently squeezes the cloth against the teeth 18*e* of the mating jaw without damaging the cloth.

The frictional engagement of the cloth in clasp 19 will increase with the number of teeth provided and the degree of protrusion by the teeth into the resilient layer 18*f*. The resilient force and the frictional force will increase as the teeth protrude further into the resilient layer 18*f*. These factors can be altered to as desired. Although clasp 19 is shown with the circular row of teeth 18*e*, the invention contemplates that any configuration of teeth will provide a degree of the advantages disclosed. For example, one or more straight rows of teeth could be utilized or a plurality of teeth could be spaced about on jaw 18*b*. It is believed that the clasp 19 is less likely to damage cloth as the gripping takes place with only one hard element, that is the teeth 18*e*.

FIG. 5, discloses a clasp 24. The clasp 24 has an upper jaw 24*a* a lower jaw 24*b* and a conventional closer lever 24*c* to close and lock the jaws 24*a* and 24*b*. The upper jaw 24*a* is provided with a row of teeth 24*d* across its width at its terminal end. Lower jaw 24*b* is similarly provided with teeth 24*e*. The teeth 24*d* and 24*e* are interdigitated so as to mesh with each other when the jaws 24*a* and 24*b* are closed.

It has been found that the configuration of clasp 24 holds garment material securely with minimal damage to the fiber thereof. For firmer gripping on materials such as silk, the invention also contemplates providing multiple rows of interdigitating teeth such as teeth 24*e* and 24*d* all extending along either the width or the length of the upper and lower jaws 24*a* and 24*b*. Rubber coating of the teeth 24*d* and 24*e* can also be optionally provided to add to the frictional ability of the clasp 24 to grip fabric.

Figure 6:
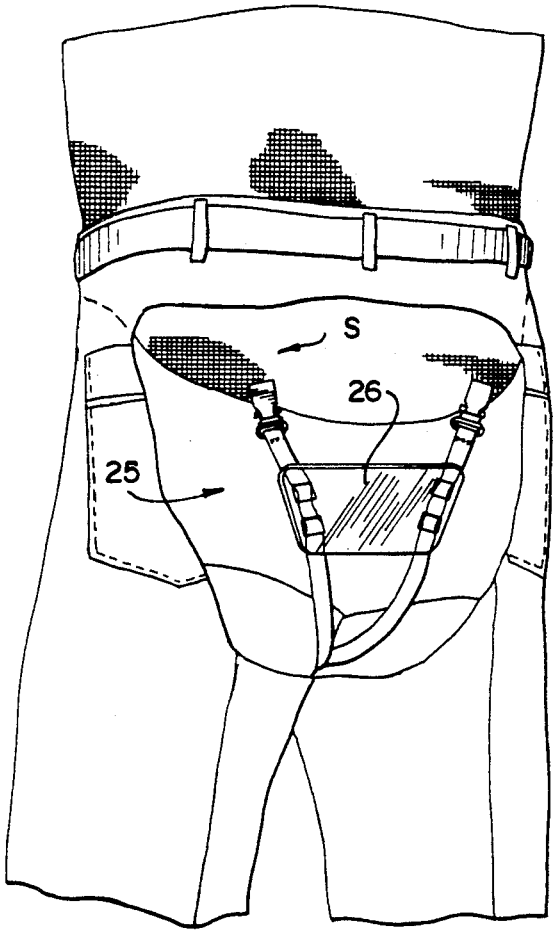
FIG. 6 is a perspective view showing another embodiment of the invention in an exemplary configuration on the rear of the wearer with a cutaway of the outer garment.
Figure 7:
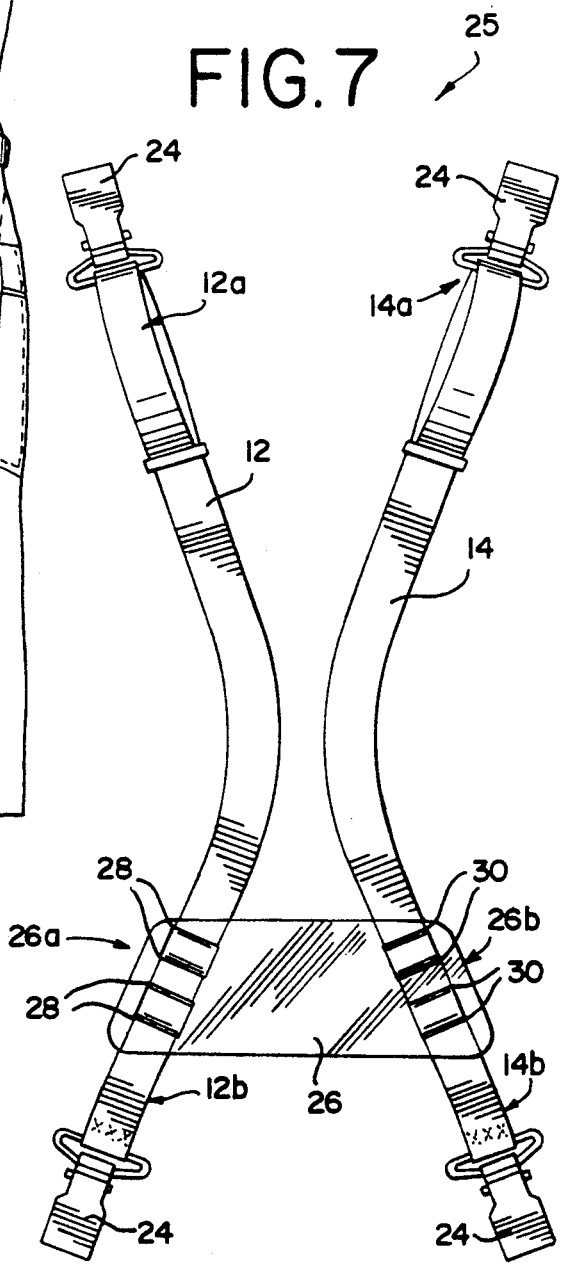
FIG. 7 is a top plan view of another embodiment of the shirttail retaining harness.

FIGS. 6 and 7 disclose a harness 25 which is the same as the harness 10 disclosed in FIGS. 1–4 except that a connecting member 26 is substituted for the connecting member 16 and the clasp 24 is substituted for the clasp 18 with all other like elements being referenced by like reference numerals.

In this embodiment, the connecting member 26 has two pairs of parallel spaced slots on each opposed end 26*a* and 26*b* thereof, slot pairs 28 and 30, respectively. The strap 12 is weaved through the slot pairs 28 and the strap 14 is weaved through the slot pairs 30. The slot pairs 28 and 30 each present a frictional drag to pull by the straps 12 and 14 but permit adjustment of the connecting member 25 along the length of the straps 12 and 14. The slot pairs 28 and the slot pairs 30 are aligned with respect to each other to cause the straps 12 and 14 to diverge at their posterior ends 12*b* and 14*b* and converge toward their anterior ends 12*a* and 14*a*. This better facilitates the straps' ability to pass through the crotch area of the wearer and being spaced for connection to the posterior shirttail S. This also aids the prevention of medial pull on the shirttail S and bunching of the straps in the rear.

Figure 8:
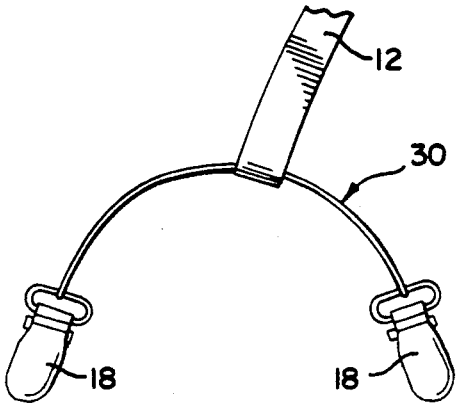
FIG. 8 is a partial view of the shirttail retaining harness showing another embodiment thereof, in perspective; and, FIG. 9 is a partial top plan view of the shirttail retaining harness showing another embodiment of a connecting member thereof.

FIG. 8 discloses an optional means for connecting the straps 12 and 14 to a shirttail S. In this embodiment, a tether 30 is provided on the ends 12*a*,14*a* and 12*b*,14*b* of the straps 12 and 14 as desired. For example, the tether 30 may be used only on the anterior ends 12*a* and 14*a* or only on the posterior ends 12*b* and 14*b* or on both as desired. Each tether 30 extends through a loop 32 formed on the end of the strap. Each loop 32 is loose fitting around its respective tether 30 to permit self adjustment of the strap during movement of the wearer. Each tether 30 is provided with a clasp such as clasp 18 or clasp 24 at its ends to permit attachment of its ends to a shirttail (not shown). In addition to self adjustment, the tether 30 effectively doubles the area of garment gripped by clasps for a more secure attachment of a harness such as harness 10 or 25. The use of the tether 30 also provides a more evenly spaced distribution of any pulling forces around a shirttail S during movement of a wearer.

FIGS. 1 and 7 show straps 12 and 14 as being arcuately shaped in a medial portion thereof. However, it is contemplated that the straps 12 and 14 are flexible and may either be preformed in this manner or can be straight elongate members.

Figure 9:
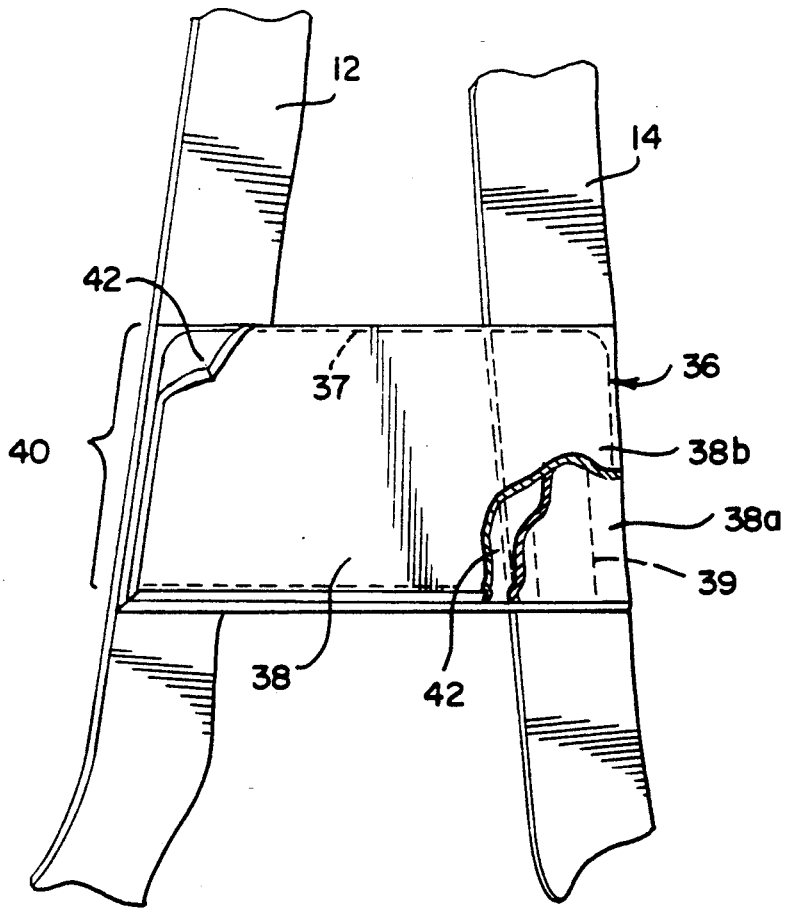

FIG. 9 discloses another embodiment of connecting member, referenced by the numeral 36. In this embodiment, a pouch 38 is defined by two superimposed layers of material 38*a* and 38*b*. The layers 38*a* and 38*b* are joined around a periphery thereof (such as by stitches 37) with the exception of a portion defining an entry slot 40. Slot 40 is large enough to permit a semi-rigid member 42 entrance and exit into the pouch 38.

In a preferred embodiment of connecting member 36, only one layer 38*a* is stitched to the straps 12 and 14 at opposite ends of the layer 38 (stitches indicated by 39 on FIG. 9). The member 42 and pouch 38 are dimensioned to extend over the width of the straps 12 and 14, as shown in FIG. 9. The pouch 36 preferably also includes a means, such as flap 44, to ensure that the member 40 does not fall out of the pouch 38. The member 40 may be removed from the connecting member 36 (pouch 38) in order to launder the harness.

While the invention has been described with reference to preferred embodiments, it will be understood by those skilled in the art that various changes may be made and equivalents may be substituted for elements thereof without departing from the broader aspects of the invention. For example, either the anterior ends 12*a* and 14*a* or the posterior ends 12*b* and 14*b* could be permanently stitched to a shirttail either during or after manufacture of the shirt or other upper garment. Also other detachable means of attaching the straps 12 and 14 to an upper garment may be employed other than clasps, for example Velcro TM fasteners, buttons or snaps.

Also, it is intended that broad claims not specifying details of a particular embodiment disclosed herein as the best mode contemplated for carrying out the invention should not be limited to such details.

We claim:

1. A shirttail retaining harness passing under a crotch area of the wearer comprising:

a pair of elongate straps each having a length and opposed ends;

a connecting member between the pair of straps, the connecting member being located away from said crotch area;

means for adjusting the connecting member along a length of the straps; and, means for connecting the straps to a garment wherein the connecting means includes each end of each strap having a cloth gripping member attached thereto, each cloth gripping member further comprising: a pair of jaws, each jaw having a length, a width and opposed first and second ends, the pair of jaws being cooperatively joined to provide an open and a closed position; teeth on each jaw, the teeth being cooperably aligned to mesh in the closed position of the jaws and the teeth being arranged in a plurality of cooperable upper and lower rows along the length of the jaws; and, a means for maintaining the jaws in the closed position when desired.

2. The shirttail retaining harness of claim 1 wherein: the teeth are arranged in a plurality of cooperable upper and lower rows along the width of the jaws.

3. The shirttail retaining harness of claim 1 wherein: the teeth are arranged in cooperable, generally circular upper and lower rows on the jaws.

4. The shirttail retaining harness of claim 1 wherein the connecting member comprising:

a generally flat, thin member with two generally opposed sides;

and the means for adjusting the connecting member along the straps comprising:

a first set of slots on one opposed side of the generally flat, thin member, and a second set of slots on the other opposed side thereof, one strap being weaved through the first set of slots and the other strap being weaved through the second set of slots.

5. The shirttail retaining harness of claim 4 wherein the generally flat, thin member is flexible.

6. The shirttail retaining harness of claim 4 wherein the first and second set of slots are aligned with respect to each other to cause the pair of straps weaved therethrough to be non parallel in relation to each other.

7. The shirttail retaining harness of claim 1 wherein the means for connecting the straps to a garment comprising:

a loop on the end of each strap;

a separate tether extending through each loop, the tethers having opposed ends, each of the opposed ends having a means for gripping a garment.

8. The shirttail retaining harness of claim 1 wherein the means for connecting the straps to a garment comprising:

a loop on the anterior end of each strap;

a separate tether extending through each loop, the tethers having opposed ends, each of the opposed ends having a means for gripping a garment.

9. The shirttail retaining harness of claim 1 wherein the means for connecting the straps to a garment comprising:

a loop on the posterior end of each strap;

a separate tether extending through each loop, the tethers having opposed ends, each of the opposed ends having a means for gripping a garment.

10. A shirttail retaining harness passing under a crotch area of the wearer comprising:

a pair of elongate straps each having a length and opposed ends;

a connecting member between the pair of straps, the connecting member being located away from said crotch area and further wherein the connecting member comprises a pouch connecting the straps and having an opening and a semi-rigid member dimensioned to fit through the opening and removably reside in the pouch; and, means for connecting the straps to a garment.

11. A shirttail retaining harness passing under a crotch area of the wearer comprising:

a pair of elongate straps each having a length and opposed ends;

a connecting member between the pair of straps, the connecting member being located away from said crotch area; and, means for connecting the straps to a garment wherein the connecting means includes each end of each strap having a cloth gripping member attached thereto, each cloth gripping member further comprising, a first jaw; a second jaw, the first and second jaws being cooperatively joined to provide an open and a closed position; at least one protruding member on the first jaw; a resilient material on the second jaw, the protruding member engaging into the resilient material when the first and second jaws are in a closed position; and, means for maintaining the jaws in the closed position when desired.

* * * * *